US008499958B2

(12) United States Patent
Wang

(10) Patent No.: US 8,499,958 B2
(45) Date of Patent: Aug. 6, 2013

(54) KIND OF PACKING BOX OF WET WIPES

(75) Inventor: Linda Wang, Shanghai (CN)

(73) Assignee: Shanghai Shine Trade Ltd., Shanghai (CN)

( * ) Notice: Subject to any disclaimer, the term of this patent is extended or adjusted under 35 U.S.C. 154(b) by 0 days.

(21) Appl. No.: 13/595,310

(22) Filed: Aug. 27, 2012

(65) Prior Publication Data

US 2012/0325691 A1 Dec. 27, 2012

(30) Foreign Application Priority Data

May 9, 2011 (CN) ..... 2011 2 0329650 U

(51) Int. Cl.
*B65D 43/22* (2006.01)

(52) U.S. Cl.
USPC ..... 220/254.5

(58) Field of Classification Search
USPC ..... 206/205, 494, 823; 220/254.5, 263, 220/264, 827, 829
See application file for complete search history.

(56) References Cited

U.S. PATENT DOCUMENTS

| | | | | |
|---|---|---|---|---|
| 6,092,690 | A * | 7/2000 | Bitowft et al. | 220/831 |
| 6,206,221 | B1 * | 3/2001 | Bando et al. | 220/254.5 |
| 6,523,690 | B1 * | 2/2003 | Buck et al. | 206/494 |
| 6,574,834 | B2 * | 6/2003 | Fedon | 16/225 |
| 6,702,109 | B1 * | 3/2004 | Tabuchi | 206/233 |
| 7,004,349 | B2 * | 2/2006 | Heiberg et al. | 220/827 |
| 7,621,420 | B2 * | 11/2009 | Bandoh et al. | 220/326 |
| 2002/0121449 | A1 * | 9/2002 | Bowie | 206/362 |
| 2003/0111366 | A1 * | 6/2003 | Enners | 206/305 |
| 2006/0096984 | A1 * | 5/2006 | Bandoh et al. | 220/254.5 |
| 2010/0072218 | A1 * | 3/2010 | Meyer et al. | 220/834 |
| 2011/0240514 | A1 * | 10/2011 | Bandoh et al. | 206/555 |

* cited by examiner

*Primary Examiner* — Steven A. Reynolds
*Assistant Examiner* — King M Chu
(74) *Attorney, Agent, or Firm* — Muncy, Geissler, Olds & Lowe, PLLC

(57) ABSTRACT

A packing box of wet wipes, which includes a body and a cover connected to the body. The cover includes: a cover body having a press button mounted therein, a top lid having a fastening part mounted thereon and mated with the press button, and a resilient connection part having a first end secured to a side of the top lid opposite to the fastening part and a second end protruding through a through hole of the top lid and secured to the cover body. The packing box of wet wipes of present invention has a simple structure, and can be used repeatedly and easy to open.

3 Claims, 3 Drawing Sheets

KIND OF PACKING BOX OF WET WIPES

FIELD OF THE INVENTION

The present invention relates to a packing box of wet wipes, and particularly to a packing box of wet wipes that can be used repeatedly.

DESCRIPTION OF RELATED ART

As the rise of the standard of living and the improvement of health conditions, wet wipes is widely used in occasions of dinners, meetings and cars, and becomes daily cleaning appliance. However, the packages of the wet wipes are mostly in a form of plastic bags or barrels. Packaging using plastic bags are not desirable for convenient usage, and also the waste plastic bags can bring about severe environmental pollution. Packaging using barrels are not desirable either and make the wet wipes unsanitary. Now it is provided that a packaging barrel of wet wipes with a hole, but its irrational structure is also undesirable for use and cause waste of the wet wipes, and further cannot assure the sanitation of the wet wipes due to the unsatisfactory use.

SUMMARY OF THE INVENTION

In view of the foregoing problems, the present invention is to provide a box as packing box of wet wipes that can solve the problems described above.

To achieve the objective, a packing box of wet wipes in accordance with the present invention is provided and comprising:

a body; and a cover connected to the body and further comprising: a cover body having a press button mounted therein, a top lid having a through hole and a fastening part mounted thereon and mated with the press button, and a resilient connection part having a first end secured to a side of the top lid opposite to the fastening part and a second end protruding through the through hole of the top lid and secured to the cover body.

For further technical features of the present invention, the resilient connection part is an O-ring, the sealing part has a first boss and the cover body has a second boss, an end of the O-ring is secured to the first boss, protruding through the through hole and secured to the second raised boss.

For further technical features of the present invention, the cover body has a first raised edge, and the top lid has a second raised edge mated with the first raised edge.

For further technical features of the present invention, the cover body has a diaphragm and the diaphragm has an opening, and the top lid has a third raised edge mated with the border of the diaphragm.

Due to the technical solutions, the packing box of wet wipes of the present invention has a simple structure and can be used repeatedly and easy to open.

DETAILED DESCRIPTION OF THE PREFERRED EMBODIMENTS

The present invention is more specifically described in the following paragraphs of the embodiments.

Figure 1:
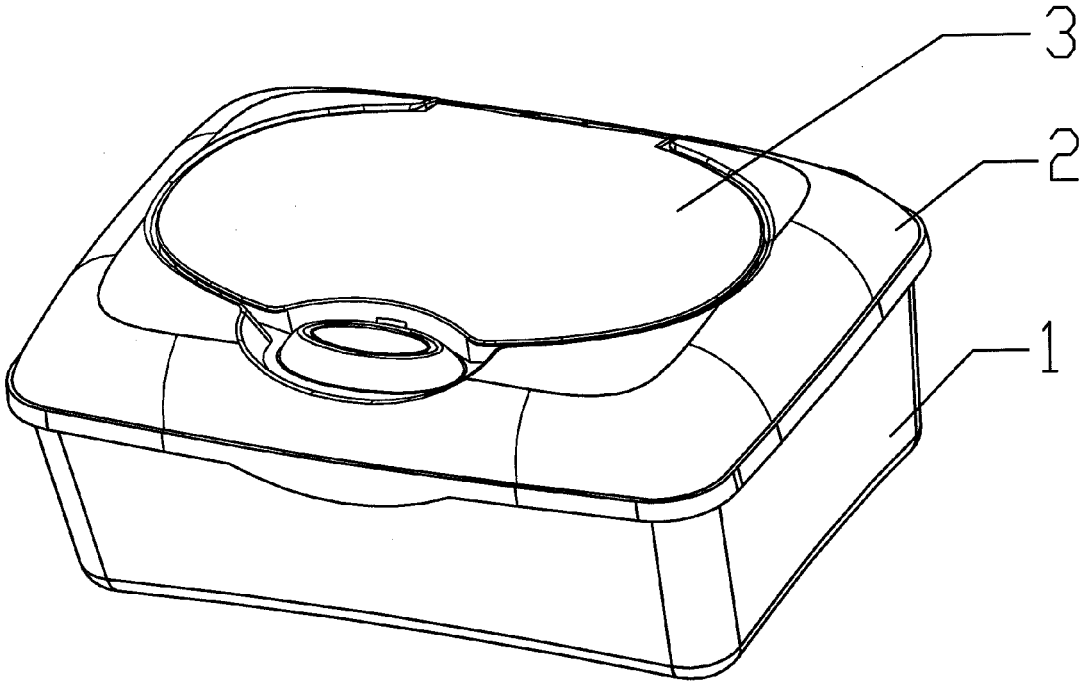
FIG. 1 is a schematic view of structure of a packing box of wet wipes according to the present invention.
Figure 2:
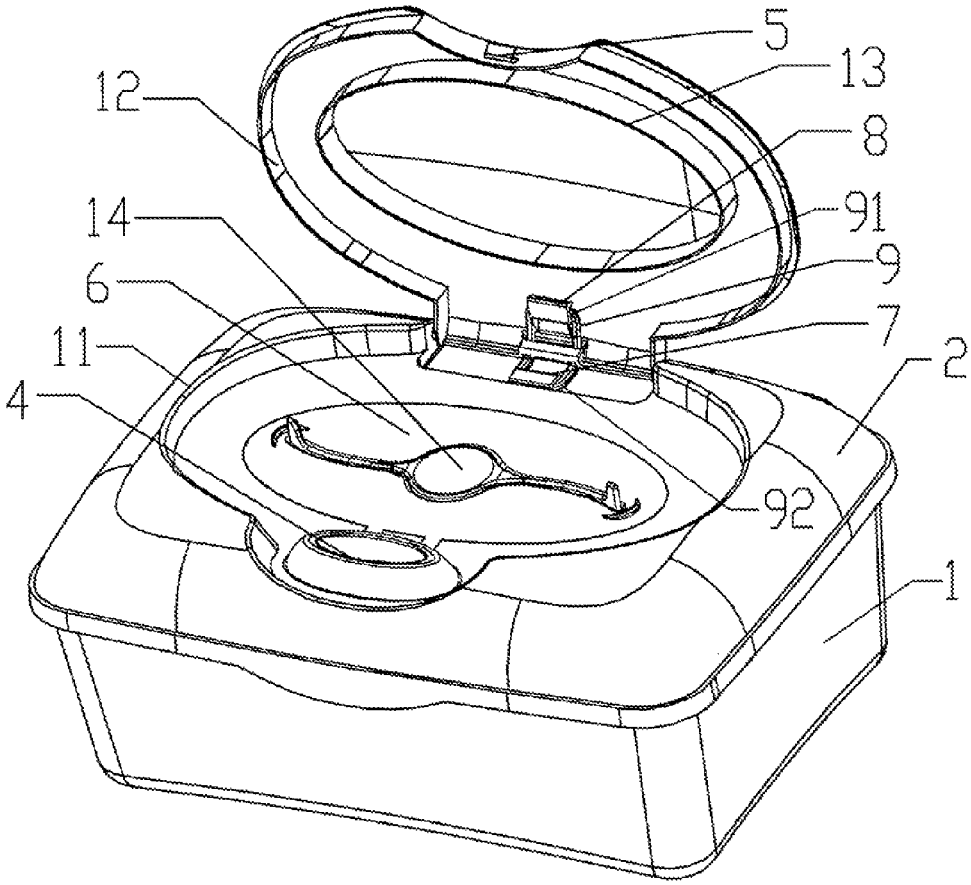
FIG. 2 is a schematic view of unfold structure of a packing box of wet wipes according to the present invention.
Figure 3:
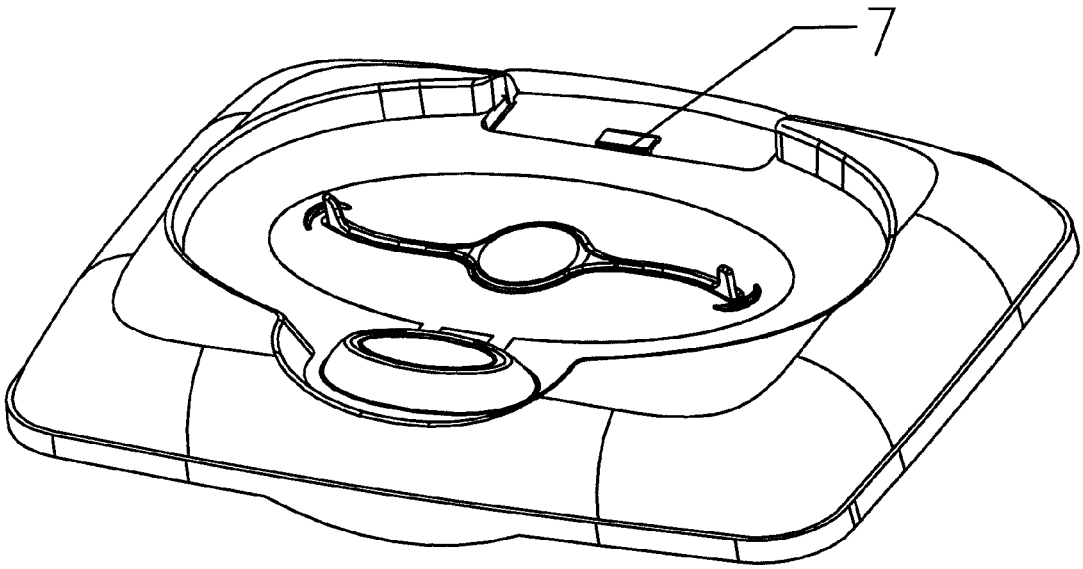
FIG. 3 is a schematic view of structure of a cover body of a packing box of wet wipes according to the present invention.
Figure 4:
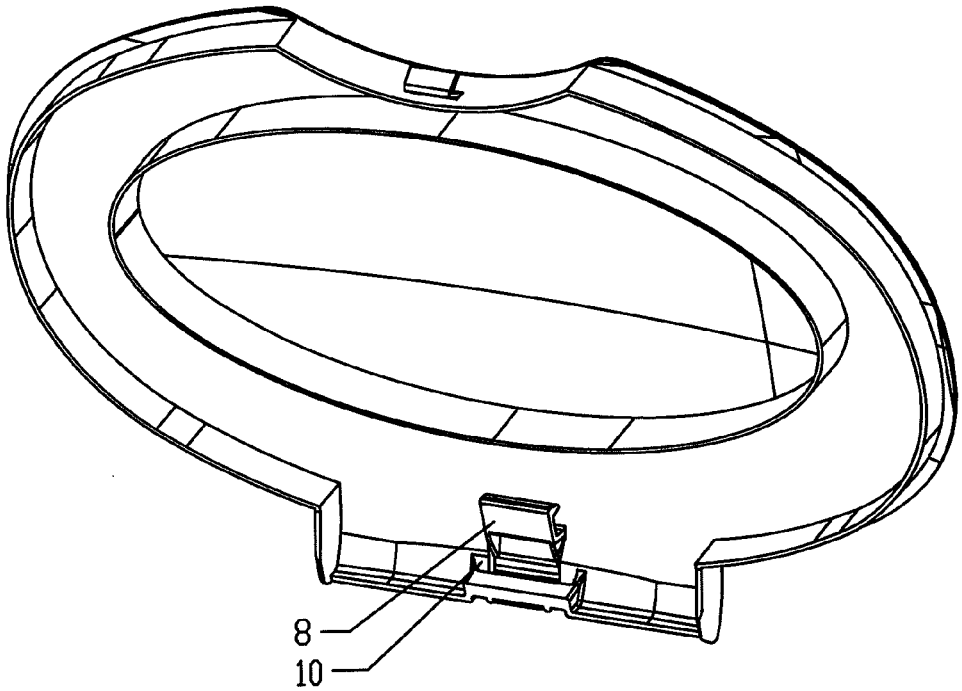
FIG. 4 is a schematic view of structure of a top lid of a packing box of wet wipes according to the present invention.

With reference to FIGS. 1 to 4, a packing box of wet wipes in accordance with the present invention is provided, which comprises a body 1 and a cover connected to the body 1. The cover further comprises a cover body 2 that has a press button 4 mounted therein; a top lid 3 that has a through hole 10 and a fastening part 5 mounted thereon and mated with the press button 4; and a resilient connection part 9 having a first end 91 secured to a side of the top lid 3 opposite to the fastening part 5 and a second end 92 protruding through the through hole 10 of the top lid 3 and secured to the cover body 1.

The cover body has a first raised edge 11, and the top lid 3 has a second raised edge 12 mated with the first raised edge 11. The cover body 2 has a diaphragm 6. The diaphragm 6 has an opening 14, and the top lid 3 has a third raised edge 13 mated with the border of the diaphragm 6.

In this embodiment, the resilient connection part 9 is an O-ring. The top lid 3 has a first boss 8 and the cover body 2 has a second boss 7, an end of the O-ring is secured to the first boss 8 and protruding through the through hole 10 and then secured to the second raised boss 7. The O-ring can be made of silica gel, or other alternative elastic materials.

In use, the body 1 and the cover are open. Wet wipes is put into the body 1. Then, the body 1 and the cover are fastened closely. As in need of the wet wipes, the press button 4 is pressed downward and the fastening part 5 which was connected securely to the press button 4 is released. Since the resilient connection part 9 is tensile and the sealing part 3 can be bounced upward, the wet wipes can be taken through the opening 14 of the diaphragm 6. After use, the top lid 3 is pressed downward. The fastening part 5 and the press button 4 are securely connected together. At this time, the resilient connection part 9 is tensile.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A packing box of wet wipes, comprising:

a body; and a cover connected to the body and further comprising:

a cover body having a press button mounted therein;

a top lid having a through hole and a fastening part mounted thereon and mated with the press button; and a resilient connection part having a first end secured to a side of the top lid opposite to the fastening part and a second end protruding through the through hole of the top lid and secured to the cover body, wherein the resilient connection part is an O-ring, the top lid has a first boss and the cover body has a second boss, an end of the O-ring is secured to the first boss, protruding through the through hole and secured to the second raised boss.

2. The packing box of wet wipes as claimed in claim 1, wherein the cover body has a first raised edge, and the top lid has a second raised edge mated with the first raised edge.

3. The box as packing box of wet wipes as claimed in claim 1, wherein the cover body has a diaphragm and the diaphragm has an opening, and the top lid has a third raised edge mated with the border of the diaphragm.

* * * * *